United States Patent [19]

Meyer

[11] Patent Number: 4,691,389

[45] Date of Patent: Sep. 8, 1987

[54] CAP HAVING STIFFENERS

[75] Inventor: Eugene F. Meyer, Louisville, Ky.

[73] Assignee: Town Talk, Inc., Louisville, Ky.

[21] Appl. No.: 926,507

[22] Filed: Nov. 3, 1986

[51] Int. Cl.[4] ..... A41B 1/02

[52] U.S. Cl. ..... 2/195; 2/256

[58] Field of Search ..... 2/195, 255, 256

[56] References Cited

U.S. PATENT DOCUMENTS 2,701,366 2/1955 Oberrender ..... 2/195

3,133,289 5/1964 Lipschultz ..... 2/255

*Primary Examiner*—Doris L. Troutman

*Attorney, Agent, or Firm*—Harry B. O'Donnell, III

[57] ABSTRACT

A cap having a crown formed of a plurality of crown segments located in side-by-side relationship and having a visor attached to the crown brim and extending outwardly therefrom. The crown segments are seamed together adjacent to their contiguous edges. The visor is laterally centered on and attached to the front of the crown brim and the junctures of the peripheral edge of the visor and the crown brim are proximate to two of the crown segment seams, such that the visor is centered between those two segment seams. A strip of seam tape is located beneath the segment seams on the inside of the crown. A stay of stiffening material is located under each of the two crown seams proximate to the junctures of the visor and the crown brim and is disposed between the strip of seam tape and the inside surface of the crown.

6 Claims, 8 Drawing Figures

FIG. 6
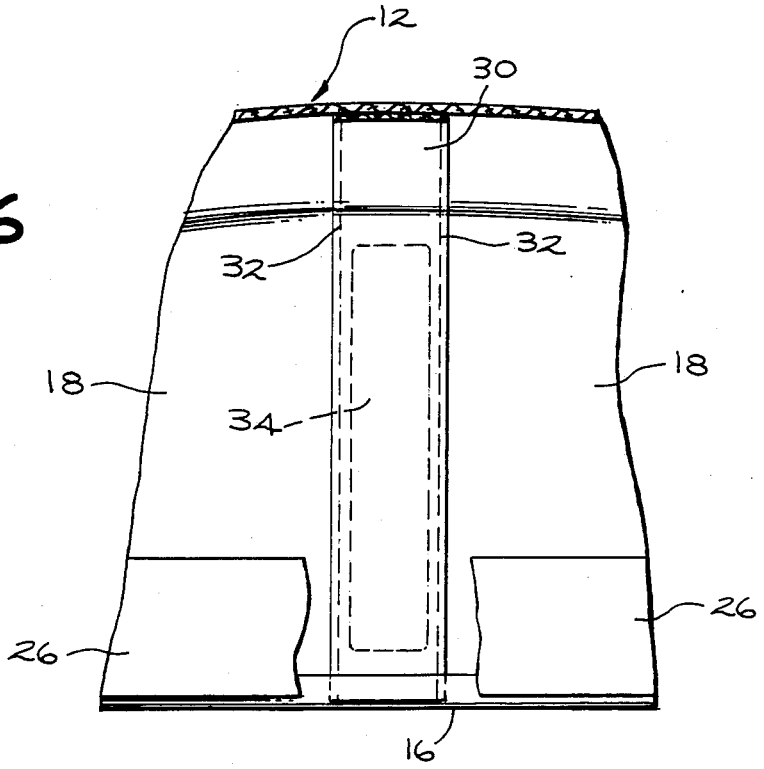
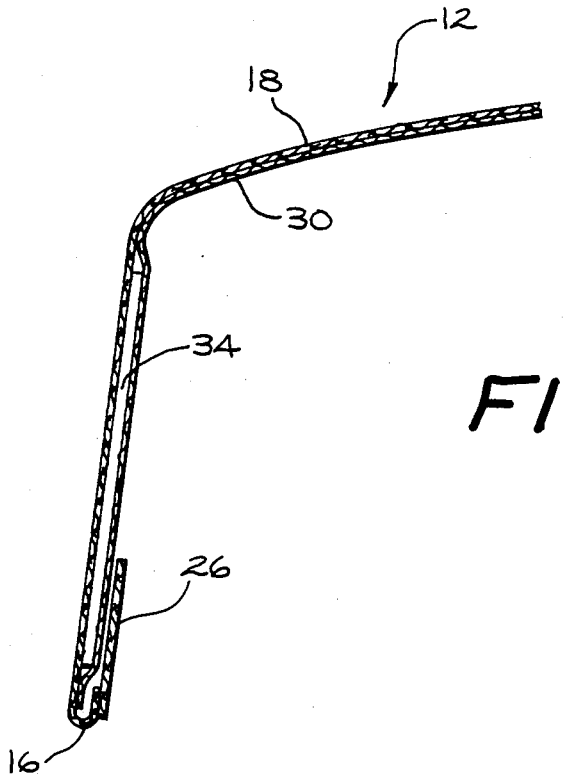
FIG. 8

CAP HAVING STIFFENERS

BACKGROUND OF THE INVENTION

This invention relates to head wear and, more particularly, caps having stiffening elements in their crown.

Caps of the type including a visor extending from the cap crown are very popular. They are not only worn while participating in a sport, such as baseball or golf, but often are worn just as casual wear. Caps of this type are also frequently used to promote businesses and products by placing a logo or emblem on front side of the cap crown above the visor.

There are a number of drawbacks with prior-art caps of this type.

Preferably, cap crowns are made of a fabric material that is soft, pliable and light weight and, therefore, comfortable to wear. However, with prior-art caps, the crown is not self supporting and, therefore, the crown tends to collapse. The result is that not only does the cap look sloppy, but any logo, emblem or insignia on the front of the crown is less visible.

It has been known previously to add stiffening elements to caps to prevent the collapse of the crown.

U.S. Pat. No. 2,701,366, issued on Feb. 8, 1955 to R. R. Oberrender, typified the approach of adding stiffener means around the entire crown of the cap. The stiffener means are strips of stiff material extending upwardly of the crown in circumferentially spaced relationship around the crown and anchored to the cap lining by stitching them directly to the cap lining. Caps employing this old construction present an overall stiff or upright crown, which is quite formal in appearance.

U.S. Pat. No. 3,133,289 issued on May 19, 1964 to Frank K. Lipschultz exemplifies yet another old approach for stiffening a cap crown using a sheet of fabric material which is somewhat flexible, but sufficiently rigid to underlie and support the front portion of the cap crown on the inside of the crown. These sheets of fabric material are typically inserted into the head band of cap crown, or, as shown in this old Lipschultz patent, are inserted into a pocket formed between the front of the cap crown and a second piece of material stitched to and underlying the front of the cap crown on the inside of the crown. This old construction is not only expensive, but, in practice, does not adequately prevent the cap crown from collapsing.

SUMMARY OF THE INVENTION

It is an object of the present invention to provide a cap with a crown which has a casual appearance, but wherein the crown is supported from collapsing, particularly at the front of the crown above the cap visor.

More particularly, the present invention provides a cap comprising: a crown having a brim and including a pluralilty of segments located in side-by-side relationship, with side edges of the crown segments extending upwardly from the crown brim and each crown segment being fastened to its contiguous crown segment along a crown seam adjacent to their contiguous edges; a visor laterally centered on and attached to the front of the crown brim to extend outwardly therefrom, with the junctures of the peripheral edge of the visor and crown brim being proximate to two of the crown seams; a strip of seam tape attached beneath the crown seams on the inside surface of the crown; and a stay of stiff material located under each of the two crown seams proximate to the junctures of the peripheral edge of the visor and crown brim and disposed between the seam tape and inside surface of the crown.

BRIEF DESCRIPTION OF THE DRAWINGS

The features and advantages of the present invention will become even more clear upon reference to the following description in conjunction with the accompanying drawings in which the numerals refer to like parts throughout the several views and wherein:

FIG. 6 is an enlarged, partly-broken, fragmentary view of a seamed area of the cap, taken along line 6—6 of FIG. 4;

FIG. 8 is an enlarged fragmentary cross-sectional view of a seamed area of the cap, taken along line 8—8 of FIG. 5.

DETAILED DESCRIPTION

Figure 1:
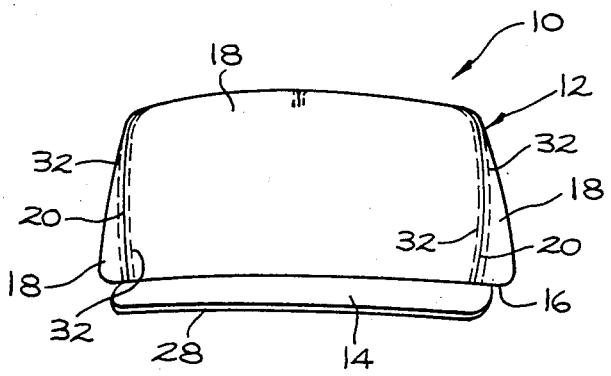
FIG. 1 is a front elevational view of a cap of the present invention.
Figure 2:
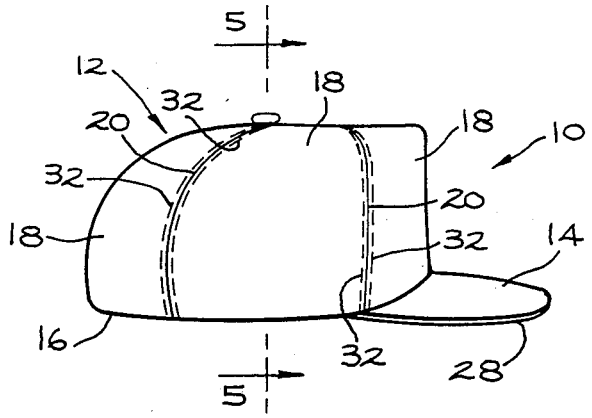
FIG. 2 is a right side elevational view of the cap of FIG. 1.
Figure 3:
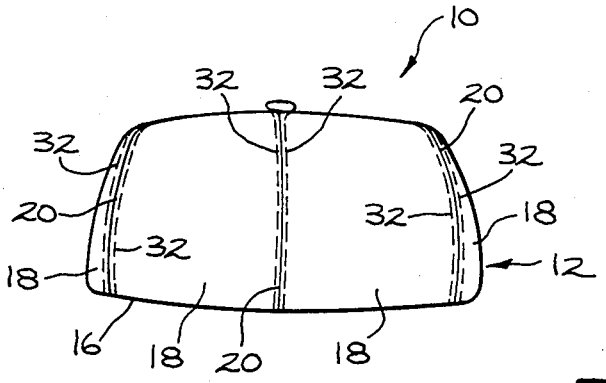
FIG. 3 is a rear elevational view of the cap of FIG. 1.

As best shown in drawing FIGS. 1 through 3, there is illustrated a presently preferred embodiment of a cap 10 constructed in accordance with the present invention. The cap 10 comprises a crown 12 and a visor 14 attached to the crowm brim 16 and located at the front of the crown 12 to extend outwardly therefrom.

Figure 4:
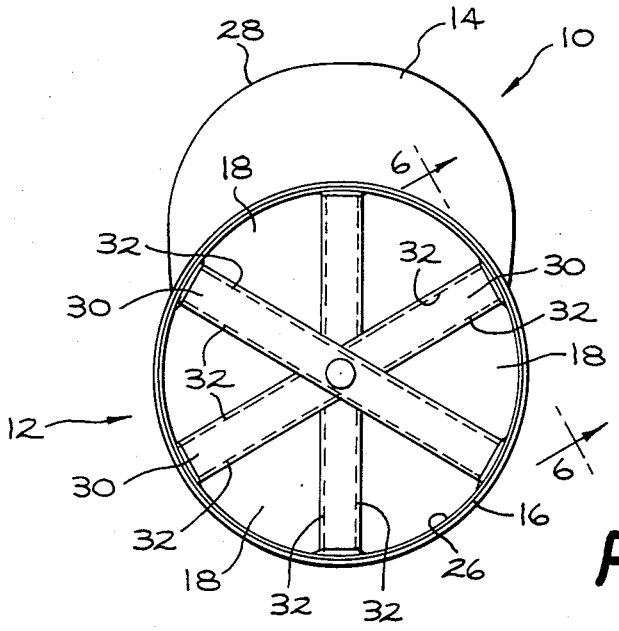
FIG. 4 is a bottom view of the cap of FIG. 1.
Figure 5:
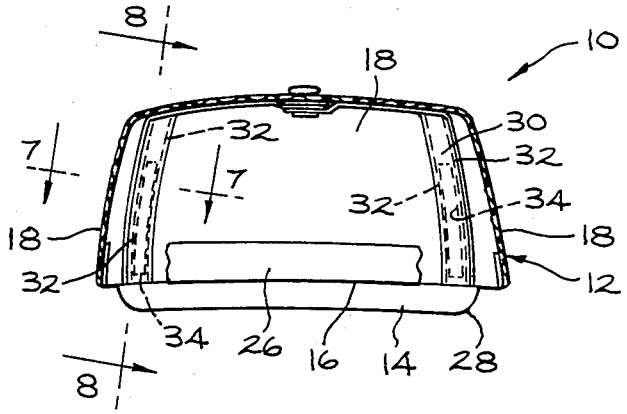
FIG. 5 is a cross-sectional view of the cap, taken along line 5—5 of FIG. 2.
Figure 7:
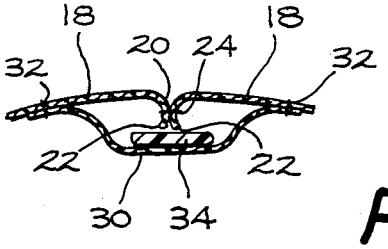
FIG. 7 is an enlarged fragmentary view of a seamed area of the cap, taken along line 7—7 of FIG. 5.

With continued reference to drawing FIGS. 1-3 and further reference to drawing FIGS. 4 and 7, the crown 12 is formed of a plurality of generally triangular crown segments 18 formed of a soft fabric such as wool, cotton and the like. The crown segments 18 are located in side-by-side relationship, with the side edges 22 of the crown segments 18 extending upwardly from the crown brim 16. Each crown segment 18 is fastened to its contiguous crown segments 18 along a crown seam 20 that is adjacent to and generally aligned with their contiguous side edges 22. As best shown in drawing FIGS. 4 and 7, the adjacent contiguous crown segment edges 22 are folded inwardly of the crown 12 and attached together by fastener means, for example, a line of stitching 24. A circumferential head band 26 is attached to the interior surface of the crown 12 around the crown brim 16.

As further shown in drawing FIGS. 1-5, the visor 14 is attached to the crown brim 16 and is laterally centered on at least one of the crown segments 18. As illustrated, the visor 14 is laterally centered on one front crown segment 18. However, it is foreseeable that the segments 18 could be of a smaller size than those shown in the drawings, and, in that event, the visor 14 would be laterally centered on several front crown segments. The junctures of the peripheral edge 28 of the visor 14 and the crown brim 16 are proximate to two of the front crown seams 20, such that the visor 14 is centered between those two crown seams.

Now, with reference to drawing FIGS. 4 through 8, a strip of seam tape 30 is attached beneath each of the crown seams 20 on the inside surface of the crown 12. The strips of seam tape 30 cover the folded-over edges 22 of the crown segments 18 and extend the length of the crown seams 20. As illustrated, each strip of seam tape 30 is attached to the contiguous crown segments 18 on opposing sides of their interposed crown seam 20 by spaced apart lines of stitching 32 which are generally aligned with that crown seam 20.

With continued reference to drawing FIGS. 4–8, a stay 34 made of a stiff material is located under only each of the two crown seams 20 that are proximate to the two junctures of the peripheral edge 28 of the visor 14 and the crown brim 16. Preferably, the stays 34 are fabricated of a material such as rigid plastic so that they will not deteriorate when subjected to moisture, heat and cold. Each stay 34 is located between the strip of seam tape 30 and inside surface of the crown 12, between the spaced apart lines of stitching 32, and, thus, is centered laterally under the crown seam 20. Furthermore, each stay 34 extends from proximate to the crown brim 16 along the crown seam 20 and terminates a predetermined distance short of the top of the crown 12. As best shown in drawing FIG. 6, each of the two stays 34 extends about one-half the length of the crown seam 20. That is, the stays 34 extend from proximate to the crown brim 16 to about one-half the distance between the crown brim 16 and top of the crown 12. It should be observed that the stays 34 are free of, that is, not attached to either the cap crown 12 or seam tape strip 30.

The stays 34 support the crown segment 18 at the front of the cap 10 that is laterally centered with the visor 14, thus clearly displaying any indicia located on the front of the cap crown 12, while still providing a casual soft appearance to the cap crown 12.

It should be further apparent that while there have been described what are currently considered to be presently preferred forms of the present invention in accordance with the Patent Statutes, changes may be made in the disclosed cap structure without departing from the true spirit and scope of this invention. It is, therefore, intended that the appended claims shall cover such modifications and applications that may not depart from the true spirit and scope of the present invention.

What is claimed is:

1. A cap comprising:

(a) a crown having a brim and including a plurality of crown segments located in side-by-side relationship, with side edges of the crown segments extending upwardly from the crown brim and each crown segment being fastened to its contiguous crown segment along a crown seam adjacent to their contiguous edges;

(b) a visor laterally centered on and attached to the front of the crown brim to extend outwardly therefrom, with the junctures of the peripheral edge of the visor and the crown brim being proximate to two of the crown seams;

(c) a strip of seam tape attached beneath the crown seams on the inside surface of the crown; and (d) a stay of stiff material located under each of the two crown seams proximate to the junctures of the peripheral edge of the visor and crown brim and disposed between the strip of seam tape and the inside surface of the crown.

2. The cap of claim 1, wherein:

(a) the strips of seam tape are attached to contiguous crown segments by spaced apart lines of stitching located on opposing sides of their interposed crown seams, and (b) each stay is located between the spaced apart lines of stitching.

3. The cap of claim 1, wherein each stay extends from proximate to the crown brim to a distance short of the top of the crown.

4. The cap of claim 3, wherein each stay extends from proximate to the crown brim to about one-half the distance between the crown brim and the top of the crown.

5. The cap of claim 1, wherein the crown segments are generally triangular in peripheral shape.

6. The cap of claim 1, wherein said visor is laterally centered on one of said crown segments.

* * * * *